US006349490B1

(12) United States Patent
Gross et al.

(10) Patent No.: US 6,349,490 B1
(45) Date of Patent: Feb. 26, 2002

(54) IRONING BOARD COVER SET AND AN IRONING BOARD TOP OR IRONING BOARD USING THE COVER SET

(75) Inventors: Christian Gross, Netphen; Stephan Gerster, Neunkirchen, both of (DE)

(73) Assignee: Leifheit AG, Nassau (DE)

( * ) Notice: Subject to any disclaimer, the term of this patent is extended or adjusted under 35 U.S.C. 154(b) by 0 days.

(21) Appl. No.: 09/572,902

(22) Filed: May 16, 2000

(30) Foreign Application Priority Data

May 17, 1999 (EP) ..... 99109683
Nov. 13, 1999 (EP) ..... 99122646

(51) Int. Cl.[7] ..... D06F 83/00; D06F 81/00
(52) U.S. Cl. ..... 38/140; 38/137
(58) Field of Search ..... 38/103, 137, 140, 38/DIG. 1, DIG. 2

(56) References Cited

U.S. PATENT DOCUMENTS 1,947,613 A * 2/1934 Northup ..... 38/140
2,268,833 A 1/1942 Kowser
2,278,517 A * 4/1942 John ..... 38/140
2,481,833 A * 9/1949 Foster ..... 38/140
2,776,506 A 1/1957 Scherer
2,912,775 A 11/1959 Gettelman
3,414,995 A * 12/1968 Adiletta et al. ..... 38/140
4,043,062 A 8/1977 Lehrman
4,360,984 A * 11/1982 Ruttenberg ..... 38/140
4,484,400 A 11/1984 Lehrman
4,621,003 A * 11/1986 O'Kane ..... 38/140
4,903,421 A * 2/1990 Saito ..... 38/137

FOREIGN PATENT DOCUMENTS

GB 973849 10/1964
GB 1017572 1/1966

* cited by examiner

*Primary Examiner*—Ismael Izaguirre
(74) *Attorney, Agent, or Firm*—Frishauf, Holtz, Goodman, Langer & Chick, P.C.

(57) ABSTRACT

An ironing board cover set includes an ironing board outer cover member 7 and a pad 5 beneath it. To improve the ironing performance, a vapor barrier 6 is provided between the ironing board outer cover member 7 and the pad 5. The ironing board top 2 may be made of a plate-like member or from a sandwich plate 11.

20 Claims, 4 Drawing Sheets

IRONING BOARD COVER SET AND AN IRONING BOARD TOP OR IRONING BOARD USING THE COVER SET

REFERENCE TO RELATED APPLICATIONS

This application is based on and claims the priority of European Application No. 99122646.5 filed Nov. 13, 1999 and European Application No. 99109683.5 filed May 17, 1999, the entire contents of both of which are incorporated herein by reference.

BACKGROUND OF THE INVENTION

This invention relates to an ironing board cover set which includes an ironing board outer cover and a pad beneath the ironing board outer cover. This invention also relates to an ironing board top with such an ironing board cover set, and to an ironing board using such an ironing board cover set.

Ironing clothes with a hot iron on a padded table is an age old work method. It is among the most unpleasant household tasks, since for the most part it is done while standing, and manipulating the iron is tiring. To improve this situation, major efforts have been made both in terms of the iron and in terms of the ironing boards. For instance, irons have now been made substantially lighter in weight and are equipped with steam generators, to reduce the requisite ironing pressure on the items to be ironed.

To improve the sliding performance of irons, the irons have been equipped with various bottom or soleplate surfaces. European Patent Disclosure EP 0 378 229 A1 discloses an ironing board cover with improved sliding for the iron, a portion of whose surface is coated with a silicone elastomer, from which the soleplate of the iron picks up particles as it slides over them and thus improves the sliding performance of the iron. Disadvantages of this ironing board cover are that the lubricant coating is effective for only a limited time until it wears down, that the ironing board cover must not be washed, and finally that it is uncertain whether harmful vapors may be produced if the ironing board cover is not used completely correctly. The instructions for use by one vendor, for instance, say that the ironing board cover before its first use should be ironed while dry with a hot iron for about two to three minutes, during which time the room must be well ventilated.

The object of the present invention is to provide an easily manipulated ironing board with a textile ironing board outer cover which provides improved sliding for the iron, whose sliding improvement effect remains constant over the life of the ironing board cover, which can be cared for in the normal way (that is, the ironing board cover is washable), and wherein no coatings whatever that contain plastics, from which vapors could escape if they are excessively heated, are used. Such an ironing board cover makes enhanced ironing performance possible.

SUMMARY OF THE INVENTION

According to the present invention, the above object is attained in that a vapor or steam barrier is provided between the ironing board outer cover and the pad. The vapor or steam barrier, which can also be called a vapor barrier layer, prevents the passage of steam to the bottom, so that a vapor cushion or warm-air cushion builds up that significantly enhances the sliding performance of the iron. The sliding effect of the iron is improved considerably.

The best result is obtained if the passage of steam through the board is prevented entirely, or in other words if a vapor seal is provided. The effect of sliding improvement according to the invention remains constant over the life of the ironing board cover. The ironing board cover of the present invention can be cared for normally, that is, it is washable. Moreover, it is possible to dispense with any coating with plastics, from which vapors could possibly escape in the event of excessive heating.

The design of the previously known ironing boards is marked by an expanded metal or perforated plate, on which padding rests that in turn is covered by the actual ironing board outer cover. One such version is shown, for example, in British Patent No. 1,017,572. This design is always justified in advertising by the statement that this kind of design allows the moisture produced during ironing, whether by the steam iron or by the residual moisture in the laundry, can escape toward the bottom. It appears that this statement has always been accepted without testing it. The present invention is based on the surprising recognition that the problem of dampness of an ironing board cover is in fact nonexistent, and that there is no actual necessity for removing dampness toward the bottom. Surprisingly, it has been demonstrated that, in accordance with the present invention, prevention of the passage of vapor to below leads to the production of a vapor cushion or warm air cushion that significantly enhances the sliding performance of the iron. According to the present invention, this improvement in the sliding effect is attained using a simple construction. Previously, such an effect was achieved only by complicated and expensive ironing board constructions where air is mechanically blown in through the ironing surface. The present invention achieves the improved sliding effect without the negative effect of the prior art constructions wherein the item being ironed is cooled down severely due to the blown-in air.

Preferably, the vapor barrier or vapor barrier layer of the present invention comprises an absolute steam barrier. However, a permeable membrane wherein the passage of steam therethrough is greatly slowed can be used. Such a suitable permeable material is GORTEX™. However, it can also comprise a film, and both plastic and aluminum films can be employed.

The vapor barrier or vapor barrier layer is preferably applied as a lining to the pad. This simplifies its manufacture. However the vapor barrier can also be applied as a lining to the underside of the ironing board outer cover, which again simplifies its manufacture.

In a further advantageous refinement, the vapor barrier or vapor barrier layer is placed between the ironing board outer cover and the pad.

It is also advantageous if the ironing board cover set is provided with a heat-reflective layer. This improves the effectiveness of the warm-air cushion.

The ironing board top can be an expanded metal plate or perforated plate, of the kind already known per se.

The present invention also relates to an ironing board having an ironing board cover set according to the invention and/or an ironing board top having an ironing board cover set according to the invention. The ironing board preferably has a collapsible base.

Exemplary embodiments of the invention will be described in detail below in conjunction with the accompanying drawings.

DETAILED DESCRIPTION

Figure 1:
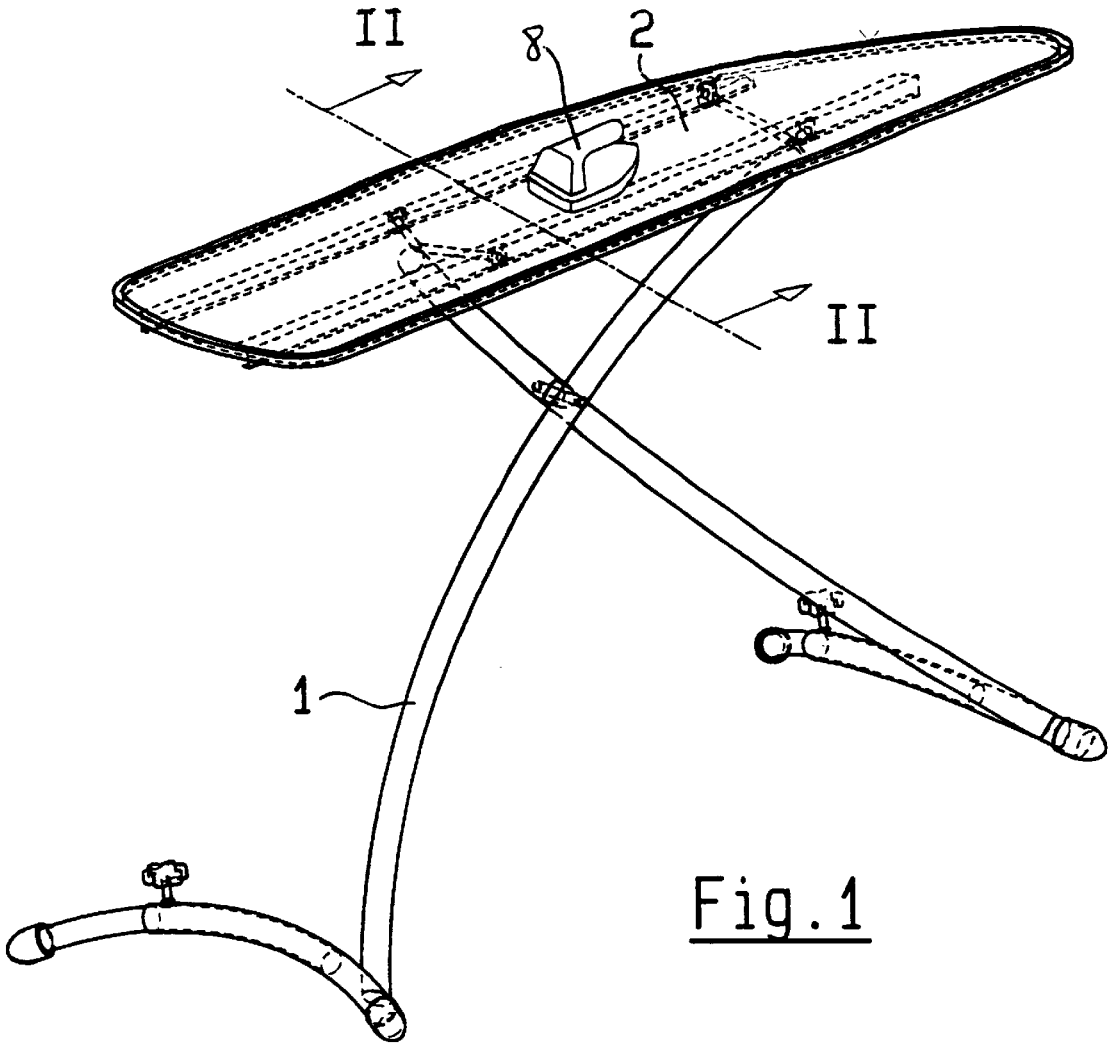
FIG. 1 is a perspective view of an ironing board.
Figure 2:
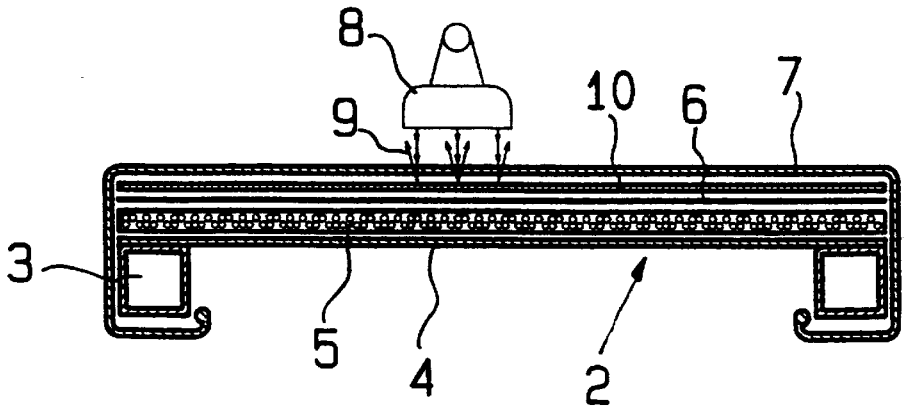
FIG. 2 is a section taken along the line II—II in FIG. 1, showing an embodiment of the present invention.

The ironing board shown in FIGS. 1 and 2 has a collapsible base 1, which supports an ironing board top 2 that is made of a square pipe frame 3 with an expanded metal top member 4 located inside the frame and supported by the frame. A foam or felt pad 5 is placed on the expanded metal to member 4. The pad 5 is covered by a vapor barrier (vapor barrier layer) or vapor seal layer 6, and an ironing board liner or outer cover 7 is located on top of the vapor barrier or vapor seal layer 6 (hereinafter referred to as "vapor barrier 6"). The vapor barrier 6 may be a layer adhered to the pad 5 or to the under surface of the liner or outer cover 7. The pad 5, vapor barrier 6 and outer cover 7 comprise a "cover set".

When ironing is done with the iron 8, the hot steam or warm air 9 passes through the ironing board outer cover 7 (made of cotton or other suitable textile material) and is reflected totally or for the most part by the vapor barrier 6, depending on the embodiment of the vapor barrier 6. This creates a warm-air and/or steam cushion 10 between the vapor barrier 6 and the ironing board outer cover 7. The effectiveness of the vapor cushion 10 can be enhanced by good thermal insulation of the pad 5, low permeability or impermeability of the vapor barrier 6 to steam—and thus good steam reflection—and by the provision of the ironing board outer cover 7 of a tight cotton weave, optionally with an additional reflective property.

The additional heat reflective property is attained by creating a heat-reflecting layer on the under surface of the ironing board outer cover, for example, by vapor-depositing aluminum on a cotton ironing board outer cover 7. It is also possible to use an ironing board outer cover 7 made of a material such as cotton or other textile material with aluminum threads woven into it. The heat-reflecting layer could also be embodied in the form of an aluminum foil directly underneath the board covering 7 of cotton, and could then simultaneously be used as the steam or vapor barrier 6.

The ironing board top 2 can be a solid sheet (plate) or a perforated plate, as is known, per se.

Preferably, the vapor barrier layer 6 is impermeable to steam and provides an absolute steam barrier. For example, such a steam-impermeable vapor barrier layer 6 can be made from an aluminum foil layer. However, the object of the invention is also attainable in a lesser embodiment, wherein the vapor barrier 6 is of such a nature that the passage of steam therethrough is very greatly slowed. Such a permeable vapor barrier 6 can be made from a layer of material such as GORTEX™ material.

Figure 3:
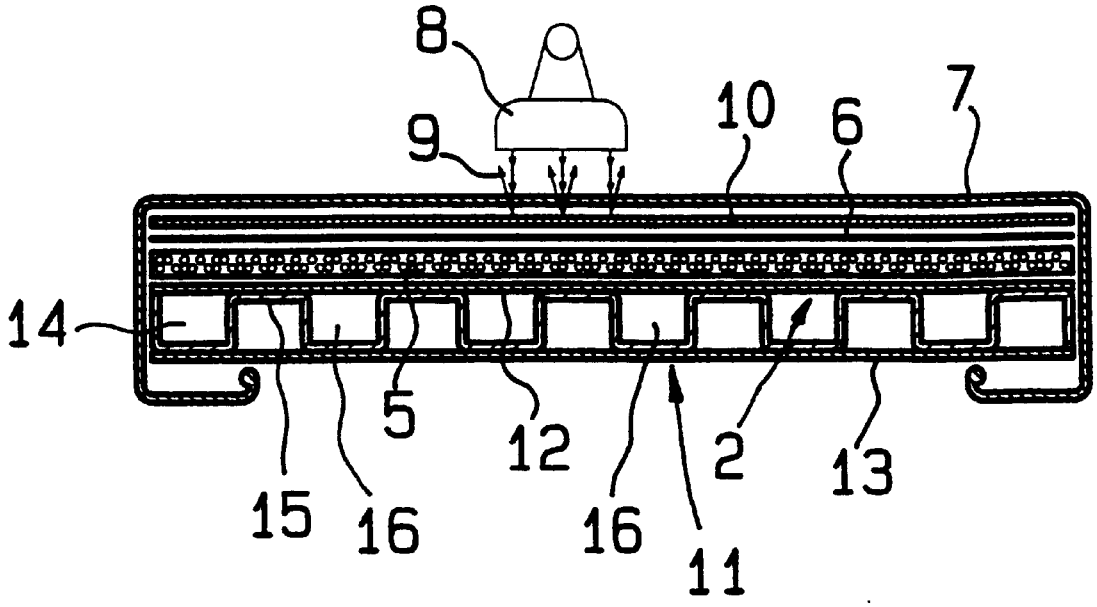
FIG. 3 is a modified embodiment in a sectional view corresponding to the sectional view of FIG. 2.

In FIG. 3, an alternative version of an ironing board is shown in section. The ironing board top 2 of FIG. 3 is not made from a square pipe frame with expanded metal inside it; instead, it comprises a sandwich plate 11 made of plastics such as polypropylene. The sandwich plate 11 comprises a top plate 12, a bottom plate 13, and a honeycomb system 14 between them. To achieve high flexural strength in both directions, it is expedient to embody the honeycomb system 14 as truncated cylinders or combs 15, which are closed off in airtight fashion by the bottom plate 13. This creates air spaces 16 in between. From a production standpoint, it is especially advantageous to make the top plate 12 and the foam of the pad 5 from the same basic plastics material such as polypropylene, thus assuring an especially simple bond. To further simplify production, the vapor barrier 6 is also preferably made from the same basic plastics material (polypropylene, for example) comprising the top plate 12.

Figure 4:
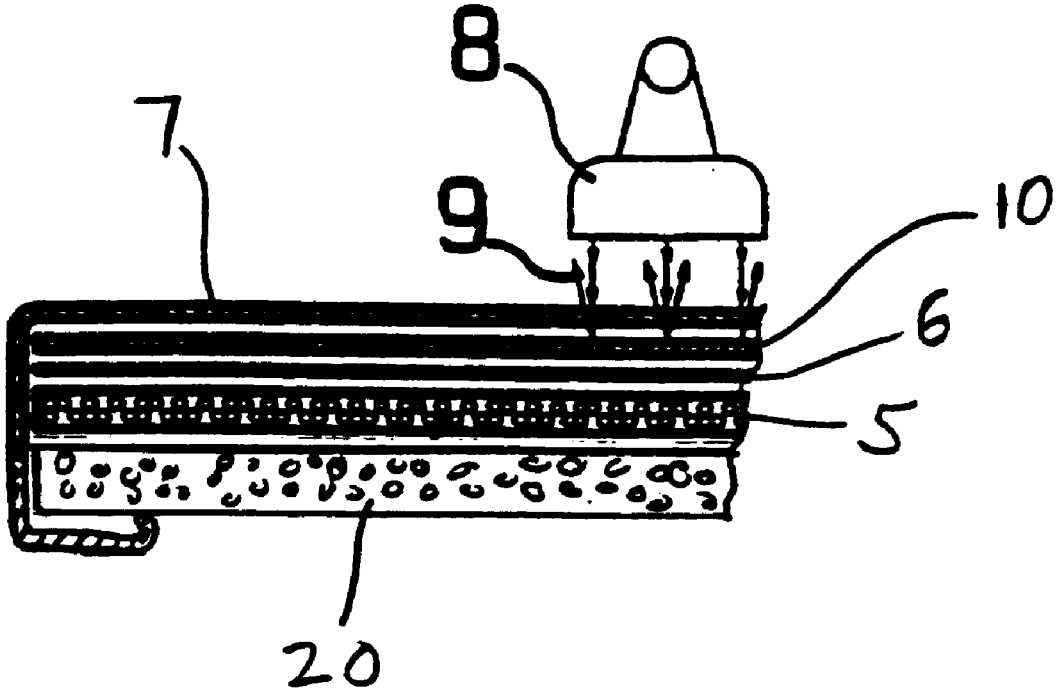
FIG. 4 shows a partial sectional view, similar to FIGS. 2 and 3, of another modified embodiment of the invention.

It is possible to replace the honeycomb system 14 with a foam plate 20 (for example, made of polypropylene), as shown in the partial sectional view of FIG. 4. The top plate 12 and/or the bottom plate 13 of the embodiment of FIG. 3 can be made of polypropylene or could be made of aluminum or wood (not shown, because the appearance would be similar to the embodiment shown in FIG. 3).

Figure 5:
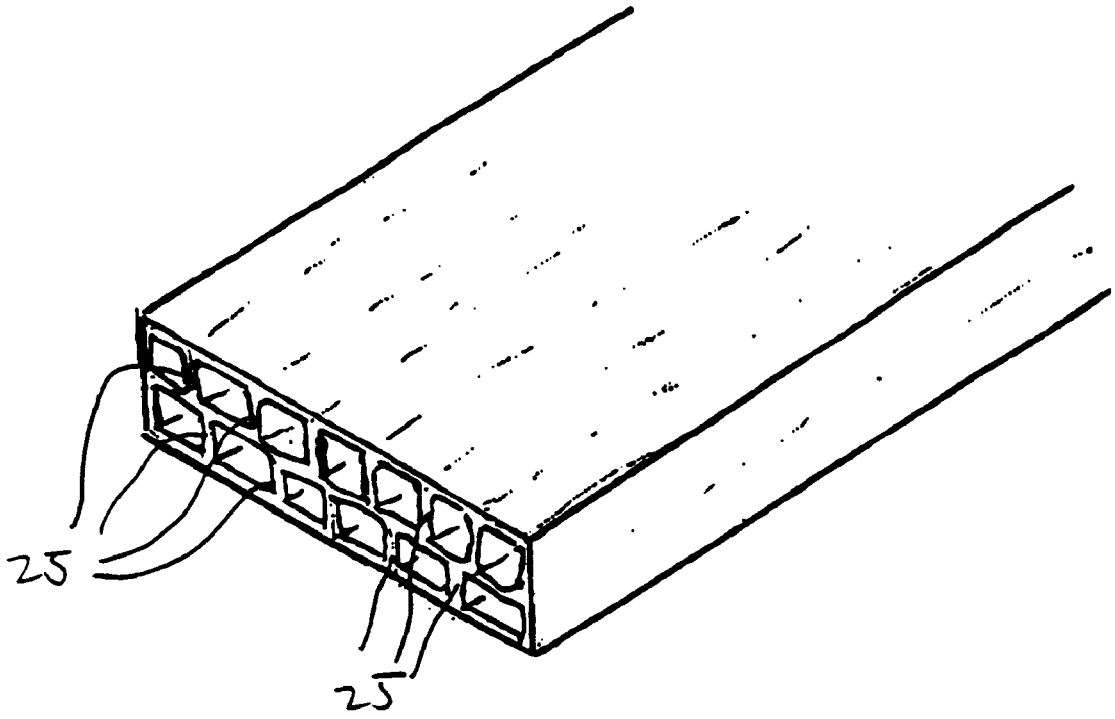
FIG. 5 shows a partial view of an extruded double-web plate (ribbed double plate) for use as the ironing board top.

It is within the scope of the invention to produce the sandwich plate 11 as a so-called ribbed plate (FIG. 3) or a ribbed double plate (i.e., a double-web plate as shown in FIG. 5) with offset ribs by an extrusion process. Such sandwich plates are preferably made of polypropylene.

It is advantageous when the ironing board top is made from a composite material. The handling of the ironing board top or ironing board and its utility are improved in multiple ways by embodying the ironing board top of a composite material. A composite material is understood to mean any type of sandwich plate, in particular a so-called rib (FIG. 3) or double-rib (FIG. 5) plate. By the use of a composite material, the weight of the ironing board top or ironing board is reduced significantly, which makes it easier for the user of the ironing board to handle the ironing board. The vapor or warm air cushion effect is also enhanced considerably, because an ironing board top made of composite material has a high thermal insulation, and the result is a very markedly increased heat buildup. This enhances the above-described sliding effect, improves the outcome of ironing, and reduces energy consumption. Furthermore, as a result of the heat insulation, residual moisture in the liner fabric is dried out completely.

As an especially compact and simple version to produce, it is attractive to embody the ironing board top as a plastic composite plate made of, for example, polypropylene. It is advantageous for both the padding and the vapor barrier to be applied as a lining. The padding and the vapor barrier lining can be made in the same operation of the production of the composite plate ironing board top. This mode of manufacture can be employed especially advantageously in the case of a composite plate, which is fabricated from cover films with molded bodies located between them. The so-called rib (FIG. 3) or double-rib (FIG. 5) plates as well as foam and honeycomb composite plates, however, are also extremely well suited to the purpose.

If the plates are embodied in smooth form, a pad can even be dispensed with, or the pad thickness can be minimized. It is advantageous if the ironing board top is heat-insulating. Accordingly, a heat-insulating composite material is preferably used for the ironing board top. However, it is also possible to make the ironing board top from other heat-insulating materials.

A further advantageous refinement is where the pad is embodied as protruding, by the thickness of the ironing board top, past the ironing board top on all sides. This protects the thin light weight textile outer cover 7 from damage by preventing direct contact of the outer cover 7 with the ironing board top.

While the invention has been described above with respect to specific embodiments, it should be clear that various modifications and alterations can be made, and that specific features of the various embodiments can be combined in any operable manner, within the scope of the appended claims.

What is claimed is:

1. An ironing board cover set providing improved sliding of an iron during ironing, the ironing board cover set comprising:

an ironing board liner or outer cover (7);

a pad (5) located beneath said ironing board outer cover (7); and a vapor barrier layer (6) provided between said ironing board outer cover (7) and said pad (5) for providing a cushion (10) of warm air and/or steam between the ironing board outer cover (7) and the pad (5).

2. The ironing board cover set of claim 1, wherein said vapor barrier layer (6) comprises a vapor seal.

3. The ironing board cover set of claim 1, wherein said vapor barrier layer (6) comprises a permeable membrane.

4. The ironing board cover set of claim 1, wherein said vapor barrier layer (6) comprises a film member.

5. The ironing board cover set of claim 2, wherein said vapor barrier layer (6) comprises a film member.

6. The ironing board cover set of claim 1, wherein said vapor barrier layer (6) is applied as a lining to the pad (5).

7. The ironing board cover set of claim 2, wherein said vapor barrier layer (6) is applied as a lining to the pad (5).

8. The ironing board cover set of claim 1, wherein said vapor barrier layer (6) is applied as a lining to the underside of the ironing board outer cover (7).

9. The ironing board cover set of claim 2, wherein said vapor barrier layer (6) is applied as a lining to the underside of the ironing board outer cover (7).

10. The ironing board cover set of claim 1, wherein said ironing board outer cover (7) is provided with a heat-reflective layer.

11. An ironing board comprising:

an ironing board top; and an ironing board cover set of claim 1 on said ironing board top.

12. The ironing board of claim 11, wherein said ironing board top comprises an expanded metal or perforated plate.

13. The ironing board of claim 11, wherein said ironing board top is made from a composite material (11).

14. The ironing board of claim 13, wherein said ironing board top is in the form of a sandwich plate.

15. The ironing board of claim 11, wherein said ironing board top is made of heat-insulating material.

16. The ironing board of claim 13, wherein said ironing board top is made of heat-insulating material.

17. The ironing board of claim 14, wherein said ironing board top is made of heat-insulating material.

18. The ironing board of claim 11, wherein said pad (5) is applied as a lining to said ironing board top (2, 11).

19. The ironing board of claim 11, wherein said pad (5) protrudes, by the thickness of the ironing board top, past the ironing board top (2, 11) on all sides of the ironing board top.

20. The ironing board of claim 11, further comprising a collapsible base supporting said ironing board top.

* * * * *